United States Patent [19]

Hein

[11] 3,999,892

[45] Dec. 28, 1976

[54] INTERCONNECTED PUMP CONTROL MEANS OF A PLURALITY OF PUMPS

[75] Inventor: Allyn J. Hein, Camdenton, Mo.

[73] Assignee: Caterpillar Tractor Co., Peoria, Ill.

[22] Filed: Feb. 9, 1976

[21] Appl. No.: 656,474

[52] U.S. Cl. ..... 417/216; 60/428; 60/451; 60/452; 60/486

[51] Int. Cl.[2] ..... F04B 49/08; F16D 31/02

[58] Field of Search ..... 60/428, 430, 448, 450, 60/451, 452, 486; 417/216

[56] References Cited

UNITED STATES PATENTS

| | | | |
|---|---|---|---|
| 3,767,327 | 10/1973 | Wagenseil | 417/216 |
| 3,797,245 | 3/1974 | Hein | 60/452 |
| 3,891,354 | 6/1975 | Bosch | 417/216 |
| 3,941,514 | 3/1976 | Louis et al. | 417/216 |

*Primary Examiner*—William L. Freeh
*Assistant Examiner*—G. P. La Pointe
*Attorney, Agent, or Firm*—Frank L. Hart

[57] ABSTRACT

A pump assembly having at least two variable displacement pumps each having a separate pump control assembly are interconnected for control in response one to the other. Each pump control assembly has first and second biasing means acting on a respective swash plate. The first and second biasing means have interconnecting fluid pathways formed through a pump control housing. Means are provided within the housings for modifying the discharge pressures of the separate pumps to provide a resultant pressure signal for controlling the second biasing means.

9 Claims, 2 Drawing Figures

10
28
16
24
62
68
70
12
26
18
22
62'
24'
14
20
22'
68'

16
94
96
76
110
78
100
64
42
112
32
74
82
98
38
50
"C"
"D"
65
56
30
68
54
88
"E"
48
"A"
62
"X"
24
36
84
40
60
104
83
58
"B"
22
86
80
66
44
108
90
67
72
46
52
34
"F"
"X"
102
106
92
28
26
20
10
12

INTERCONNECTED PUMP CONTROL MEANS OF A PLURALITY OF PUMPS

BACKGROUND OF THE INVENTION

In the operation of a plurality of variable displacement pumps, it is desirable to have the pump controls of each pump interconnected. Further, it is desirable to provide each pump control with means for responding to load, compensating for pressure, and controlling a servo valve of the pump controls in response to a common pressure signal that is of a magnitude that is controlled relative to the magnitudes of the pump discharge pressures.

While providing these control functions, it is desirable to maintain the pump control elements in a compact housing and maintain the number of conduits and connections at a minimum.

These pump control assemblies are often used on work vehicles, such as an excavator for example, which is subject to rough treatment and abuse. By so providing the critical elements in a compact package, the elements are protected from damage, thereby avoiding waste of material and time.

This invention therefore resides in interconnected pump control assembies of at least two variable displacement pumps having control means responsive to a signal relating to the discharge pressures of the pumps and having interconnecting fluid pathways between first and second biasing means of each pump control being positioned in a pump control housing.

DETAILED DESCRIPTION OF THE INVENTION

Figure 1:
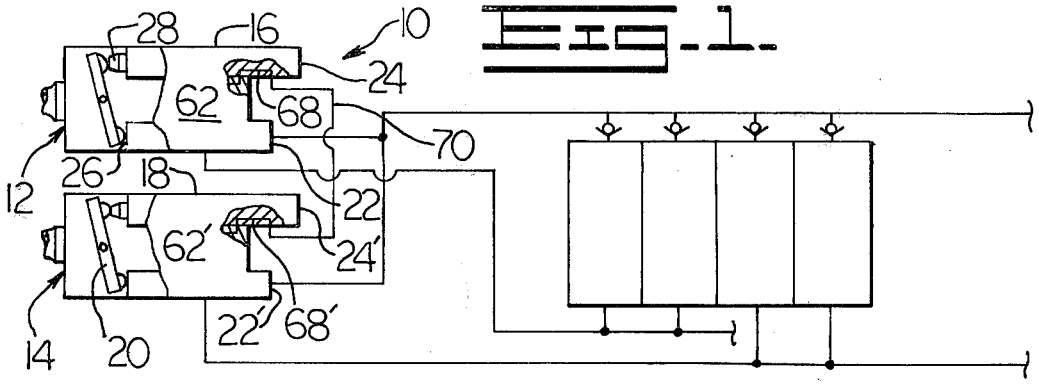
FIG. 1 is a diagrammatic view of a plurality of variable displacement pumps having their control assemblies interconnected.

Referring to FIG. 1, a pump assembly 10, for an excavator for example, has at least two variable displacement pumps 12, 14 each having a separate pump control assembly 16,18.

Each of the pump control assemblies 16,18 are preferably of common construction and for purposes of brevity reference will be made to a single assembly 16.

The pump control assembly 16 has a swash plate 20 movable between maximum and minimum discharge rate positions. The swash plate 20 is biased toward one of the maximum or minimum discharge rate positions by a first biasing means 22 and toward the other position by a second biasing means 24. Each of the biasing means 22,24 has a respective actuating element 26,28 for biasing the swash plate 20 in response to a modified discharge pressure of the respective pumps 12,14 acting in opposition to a respective load pressure signal and a preselected biasing force.

Figure 2:
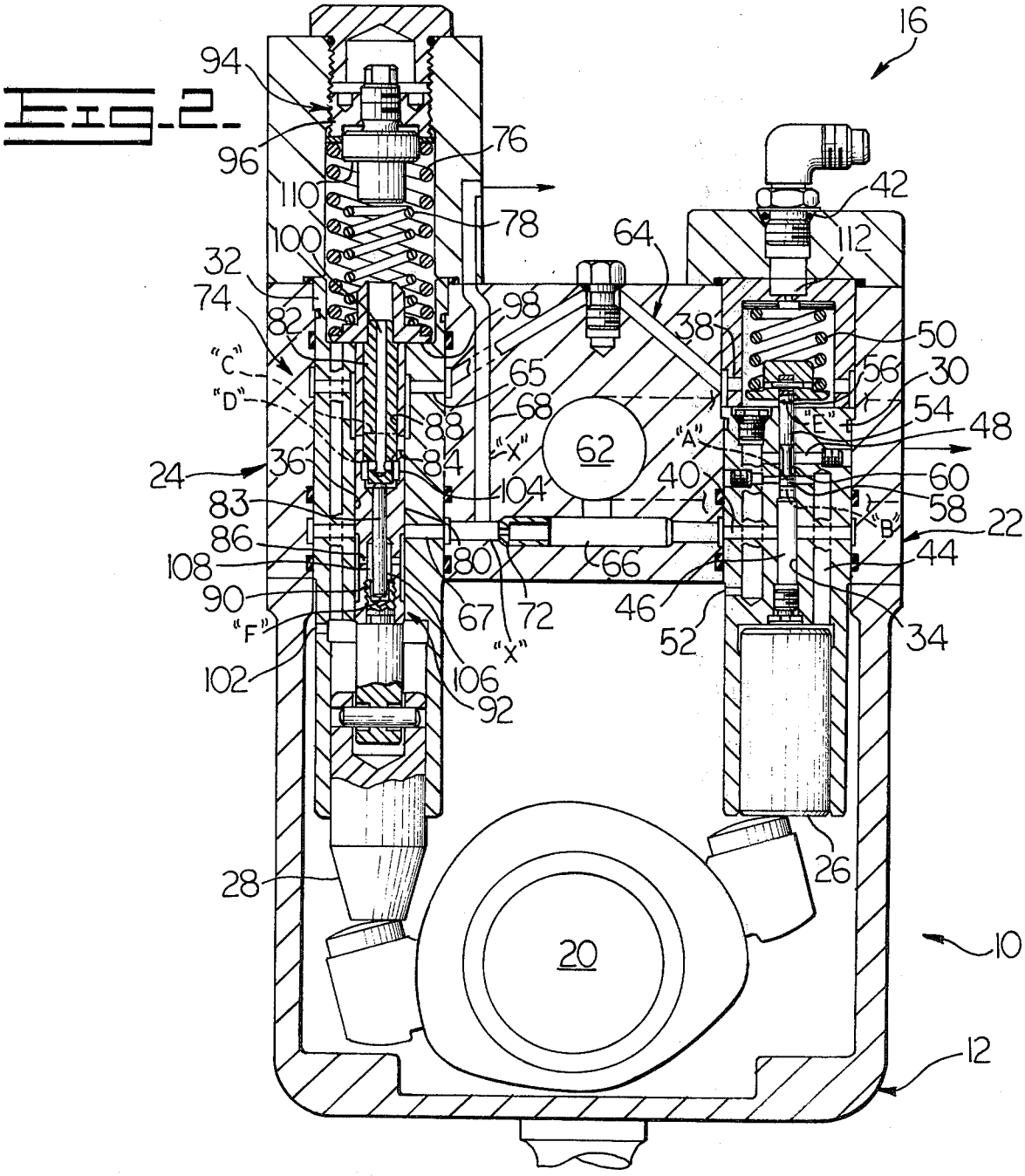
FIG. 2 is a diagrammatic partial sectional view of the control assembly of one of the pumps.

Referring to FIGS. 1 and 2, the first and second biasing means 22,24 each have a biasing means housing 30,32 and a bore 34,36. The first biasing means housing 30 has first, second, and third ports 38,40,42 opening into the bore 34 and first, second, and third chambers 44,46,48. A spring 50 is positioned in a first end of the bore 34 of the first biasing means 22 adjacent the third port 42.

The first actuating element 26 is a piston and is in fluid communication with the first chamber 44. The second fluid chamber 46 is in fluid communication with the second port 40. The third fluid chamber 48 is in fluid communication with a vent port of the housing 30. As can be seen by the drawing, the axes of the second chamber 46 and the bore 34 are preferably coaxial and portions of the first and third chambers 44,48 extend across said axes and communicate with said bore 34. Portions of the first biasing means 22 therefore intersect portions of the chambers 44,46,48.

A spool valve is movably positioned in the bore 34 between the second chamber 46 and the spring 50. One end of the spool valve 54 has a piston 56 of preselected size and is in contact with the spring 50. The other end portion of the spool valve 54 has a plug 58.

The spool valve 54 is movable between a first position shown by broken line "A," at which the plug 58 is sealing the fluid chamber 48 and the first and second chambers 44,46 are in fluid communication and a second position "B" at which the second fluid chamber 46 is sealed and the first and third chambers 44,48 are in communication. At an intermediate position shown, each chamber 44,46,48 is substantially sealed one from the others, depending upon the area and position of the transverse portion of the first chamber 44.

In order to provide the controlled selective sealing of the chambers 44,46,48, the width of the transverse portion of the first chamber 44 is sized relative to the length of the plug 58.

A pump control housing 62 connects the associated first and second biasing means 22,24 of respective pumps 12 and 14. The pump control housing 62 has a first fluid pathway 64 extending therethrough for communicating the first port 38 of housing 22 with the bore 36 of the second biasing means 24 via second housing port 65 for passing the load pressure signal from the first biasing means 22 to the second biasing means 24. A second fluid pathway 66 extends through the pump control housing 62 for connecting the discharge of the respective pump with the bore 36 of the second biasing means 24 via port 67 and the second port 40 of the first biasing means 22. A third passageway 68 extends through the pump control housing 62. One end of the third passageway 68 is connected to the second passageway 66. Referring to FIG. 1, a means 70, such as a conduit, is connected to the third passageway 68,68' of the first and second pump control housings 62,62' for communicating the discharge fluid of the first and second pumps 12,14 one with the other for modifying the discharge pressures of the pumps 12,14, and providing a resultant pressure signal "X."

The pressure signl X is preferably the average of the pump discharge pressures of pumps 12,14 provided in response to the communicating of discharge of the pumps 12,14 at a location downstream of flow restricting means 72 positioned in each second fluid passageway 66.

The flow restricting means 72 preferably have a discharge opening of common area. They can, however, have different discharge opening areas for altering the resultant pressure signal X.

Means 74 is positioned with each second biasing means 24 for controllably reducing the load pressure within the second biasing means bore 36, the first fluid pathway 64, and the first biasing means 22 in response to the pressure signal X having a magnitude greater than a preselected value.

The means 74 of each second biasing means 24 comprises first and second biasing elements 76,78, a movable sleeve 80, and a movable spool valve 82 positioned in the bore 36 of a respective second biasing means housing 32.

The sleeve 80 has first and second ports 84,86 and a central longitudinally extending opening 88 that is sealed by element 90 at the sleeve end 92 adjacent the second actuating element 28. Said sleeve end 92 is preferably connected to the second actuating element 28. It can, however, be in biasing association therewith without being actually connected thereto.

The first and second ports 84,86 each open on a side of the spool 82 and piston 83, respectively, and are at locations sufficient for being in fluid communication with respective first and second ports 65,67 of the second housing 32 at preferably all operating positions of the sleeve 80.

The first and second biasing elements 76,78 are positioned within a first end 94 of the bore 36 and there maintained by stop 96 contacting biasing element 76. Biasing element 78 is of a length sufficient for requiring biasing of the first biasing element 76 before compression of the second biasing element 78 is initiated. The second biasing element 78 can be connected to stop 96 or connected to the sleeve 80 and spool 82 via retainer 98 for traveling with said sleeve 80 and spool 82. Although a retainer 98 is here used for convenience of manufacturing, the retainer 98 can be omitted and the ends of the sleeve 80 and spool 82 formed for compressing both biasing elements 76,78 in response to movement of either element 80 or 82 toward the first end 94 of the bore 36.

The spool valve 82 is movably postioned within the opening 88 of the sleeve 80. The spool valve 82 has a longitudinal opening 100 in communication with a discharge port 1022 of the second biasing means housing 32 and an inlet port 104 which opens on a side of the spool valve 82 at a preselected location relative to the first port 84 of the sleeve 80.

The spool valve 82 in the assembled position has a piston end 106 positioned in a chamber 108 of the sleeve 80 which is in fluid communication with the second fluid pathway 66 via ports 86,67. The opposed end of the spool valve 82 is biased by the biasing elements 76,78 through the retainer 98, for example.

The spool valve 82 is movable between a first position (shown) at which the spool valve is sealing the port 84 of the sleeve, thereby sealing an end of the first fluid pathway 64 and a second position (shown by broken line "C") at which the opening 100 of the spool valve 82 is in communication with the first fluid pathway 64 via ports 104,84.

Means 110 can be provided for changing the position of the spool 82 relative to the housing 32 at which the compression of the second biasing element 78 is initiated.

Means 110 can be, for example, a threaded element mateable with threads of the stop 96 for controllable movement of the element 110 in directions toward and from the spool 82.

In describing the operation of the control systems, only the operation of the first pump control assembly 16 will be described since the operations of the assemblies 16,18 are common.

At start up there is no load pressure acting on piston 56 of the first biasing means 22 and no opposing pump discharge pressure working on piston 58 of the first biasing means 22 or piston end 106 of the second biasing means 24. At this condition, biasing element 76 of the second biasing means 24 causes the second actuating element 28 to be extended and spring 50 of the first biasing means 22 to bias plug 58 to position B which vents pressure from the first chamber 44 and permits the first actuating element 26 to be retracted.

Therefore, the only significant force on the swash plate 20 is the biasing force from the second actuating element 28 and the swash plate 20 is caused to be at the maximum disclosure rate position, as shown.

As the pump discharge pressure increases, the pressure increases in the second chamber 46 of the first biasing means 22 and in the chamber 108 of the second biasing means 22.

At this increased pressure condition, plug 58 is caused by the pressure in chamber 46 to overcome the biasing force of spring 50, move, and open the first and second chambers into fluid communication which in turn biases the first actuating element 26 into the swash plate 20 for moving the swash plate toward the minimum discharge position.

At a stabilized operating condition, the first actuating element 26 is biased toward the swash plate 20 by the pressure in the first chamber 44. The pressure of chamber 44 is controlled in response to the pump discharge pressure of the second chamber 46 acting on piston 58 and being opposed by a biasing force from spring 50 and the effective piston area "E" of piston 56 which is being acted on by a load pressure signal from conduit 70.

The second actuating element 28 is biased toward the swash plate 20 by the biasing force of the spring and by the pressure signal X acting on the piston end 106 (area "F") of the piston 83, as well as on an equal effective area of sleeve 80.

As set forth above, pressure signal X is relative to the discharge pressure of pumps 12,14 and therefore can be higher, lower, or the same as the pump discharge pressure in the second fluid pathway 66 of one of the pumps 12 or 14. Preferably, signal X is a summed average of the pump pressures. This balancing between pumps 12,14 by signal X provides for more efficient operation and reduction of energy consumption.

Referring to the first biasing means 22, as the load pressure varies and the discharge pressure of passageway 66 varies, spool valve 54 will be moved between positions A and B to control the force exerted upon the first actuating element 26. The effective piston area E is substantially common with the piston area of the plug and the load pressure signal will be additive to the force of the spring 50.

Referring to the second biasing means 24, as the load pressure varies and the pressure of pressure signal X varies, the second actuating element 28 is moved by the opposing first actuating element 26 through the swash plate 20 and in turn moves the sleeve 80. As the pressure signal X increases above preselected amounts, the pressure signal X acting on the preselected piston area F drives the spool 82 for increasing compression of springs 76,78. At the predetermined force of pressure signal X and at a predetermined displacement of actuating element 28, the load pressure, is controllably vented through discharge port 102, thereby altering the load biasing force of the first biasing means 22.

Maximum operating pressure is compensated for and controlled by the load pressure until a preselected output is reached by both pumps combined. This is assured by the sizing of effective area F of piston 74 relative to the opposing forces of the first and second biasing elements 76,78.

As the pressure signal X acts upon the effective area F, the load pressure is controllably vented through the discharge port 102 as the spool valve 82 moves from position D to C.

By flow restricting means 112, the load signal can be altered in one pump without affecting the load pressure in the other pump. As the signal pressure X causes the spool valve 82 to shift, the sleeve 80 follows in a typical servo action. The maximum pump output flow and the maximum output pressure of each pump is thereby limited.

Other aspects, objects, and advantages of this invention can be obtained from a study of the drawings, the disclosure, and the appended claims.

What is claimed is:

1. In a pump assembly having at least two variable displacement pumps, each having a separate pump control assembly, each having a swash plate movable between maximum and minimum discharge rate positions, each swash plate being biased toward one of the maximum or minimum discharge rate positions by a first biasing means and toward the other position by a second biasing means, said first biasing means each having an actuating element for biasing the respective swash plate in response to the discharge pressure of the respective pump acting in opposition to a respective load pressure signal and a preselected biasing force, and said second biasing means each having a housing having a bore and an actuating element for biasing the respective swash plate in response to a pressure signal X acting in opposition to preselected biasing forces, the improvement comprising:

first and second pump control housings, said pum control housings each connecting associated first and second biasing means of a respective pump, said pump control housing having a first fluid pathway therethrough for communicating the load pressure signal of the first biasing means with the bore of the second biasing means, a second fluid pathway therethrough for communicating the discharge of the respective pump with the bore of the second biasing means, and a third passageway communication with the second fluid pathway; and means connecting the third passageways of the first and second pump control housings in fluid communication with the other, for controllably combining the discharge pressure of the pumps, and providing a resultant pressure signal X.

2. Apparatus, as set forth in claim 1, including:

flow restricting means positioned in each second fluid pathway at a location upstream of the third fluid pathway.

3. Apparatus, as set forth in claim 1, including:

first means positioned within each second biasing means for controllably reducing the load pressure within the second biasing means bore, the first fluid pathway and the first biasing means in response to the pressure signal X having a magnitude greater than a preselected value.

4. Apparatus, as set forth in claim 3, wherein the first means of each second biasing means comprises:

first and second biasing elements positioned within the bore;

a sleeve having a central opening, first and second ports in communication with the respective first and second fluid pathways and a chamber and being movably positioned within the bore with one end biased by the biasing elements and the other end connected to the second actuating element; and a spool valve having a longitudinal opening in communication with a discharge port of the second biasing means housing and an inlet port opening on a side of the spool valve, said spool valve having one end positioned in the sleeve chamber, and the other end biased by the biasing elements, said spool being movable between a first position at which the spool is sealing the first fluid pathway and a second position at which the inlet port is in communication with the first port of the sleeve.

5. Apparatus, as set forth in claim 4, wherein the second biasing element of each second biasing means is of a length sufficient for compression of the first biasing means prior to said second biasing means being compressed in response to movement of the spool.

6. Apparatus, as set forth in claim 5, including:

means for changing the position of the spool relative to the housing at which the compression of the second biasing element is initiated.

7. Apparatus, as set forth in claim 1, wherein each first biasing means comprises:

first biasing means housing having a bore, a first port communicating with the first fluid pathway, a second port communicating with the second fluid pathway, and a third port for passing a pressure signal into the bore and first, second, and third chambers;

said first actuating element being a piston;

said housing first fluid chamber being in fluid communication with the piston, the second fluid chamber being in fluid communication with the second housing port and the first fluid chamber, and the third fluid chamber being in communication with a discharge port of the housing; and a spool valve having a piston of a preselected size an an opposed end portion having a plug portion, said spool valve being movable between a first position at which the plug is sealing the third chamber from communicating first and second fluid chambers and a second position at which the second fluid chamber is sealed, said plug having an end of a preselected size substantially common with the preselected size of the spool valve piston.

8. Apparatus, as set forth in claim 7, wherein the spool valve extends into a portion of the first biasing means housing bore intersecting the first, second, and third chambers.

9. Apparatus, as set forth in claim 7, wherein the axis of the spool valve and a portion of the second chamber are substantially coaxial and portions of the first and third chambers are extended across said axis.

* * * * *